US005605037A

United States Patent [19]

Ballhausen et al.

[11] Patent Number: 5,605,037

[45] Date of Patent: Feb. 25, 1997

[54] METHOD AND DEVICE FOR PRODUCING A TWISTED YARN

[75] Inventors: Ulrich Ballhausen, Krefeld; Guido Spix, Kaarst; Wilfried Rütten, Wegberg, all of Germany

[73] Assignee: Palitex Project-Company GmbH, Krefeld, Germany

[21] Appl. No.: 511,712

[22] Filed: Aug. 4, 1995

[30] Foreign Application Priority Data

Aug. 6, 1994 [DE] Germany ..... 44 27 876.4

[51] Int. Cl.[6] ..... D01H 4/00; D01H 7/86

[52] U.S. Cl. ..... 57/406; 57/58.49; 57/58.52; 57/59; 57/60; 57/408; 57/409; 57/411

[58] Field of Search ..... 57/406, 408, 411, 57/409, 59, 60, 58.49, 58.52, 58.7, 58.83

[56] References Cited

U.S. PATENT DOCUMENTS

| | | | |
|---|---|---|---|
| 2,498,921 | 2/1950 | Holm | 57/60 |
| 3,478,505 | 11/1969 | Braaten et al. | 57/59 |
| 3,703,074 | 11/1972 | Staneff | 57/408 |
| 3,757,507 | 9/1973 | Maxham | 57/156 |
| 4,567,723 | 2/1986 | Safar | 57/409 |
| 4,768,980 | 9/1988 | Sibert | 57/58.52 |
| 5,479,771 | 1/1996 | Ballhausen et al. | 57/409 |
| 5,499,496 | 3/1996 | Stenmans | 57/406 |

FOREIGN PATENT DOCUMENTS

| | | |
|---|---|---|
| 78710 | 8/1969 | Germany . |
| 2615505 | 10/1977 | Germany . |
| 4240226 | 8/1992 | Japan . |

*Primary Examiner*—William Stryjewski
*Attorney, Agent, or Firm*—Robert W. Becker & Associates

[57] ABSTRACT

A device for producing a twisted yarn has a spindle rotor with a hollow spindle axle connected to a vacuum source and also has a vacuum chamber connected to the hollow spindle axle. A fiber-dissolving device for producing individual staple fibers is provided. At least two spinning rotors are positioned in the vacuum chamber for spinning spun yarns from the individual staple fibers. A centering device is positioned above the spinning rotors on the axis of the hollow spindle axle. The spindle rotor has an annular channel for receiving the individual staple fibers from the fiber-dissolving device. The spindle rotor has supply channels connected between the annular channel and the spinning rotors for supplying the individual staple fibers from the annular channel to the spinning rotors. The spindle rotor has spun yarn removal channels for removing the spun yarns from the spinning rotors and for guiding the spun yarns to the centering device. A winding device for winding the twisted yarn, produced by the spindle rotor from the spun yarns and guided through the centering device, onto a bobbin is also provided.

16 Claims, 2 Drawing Sheets

METHOD AND DEVICE FOR PRODUCING A TWISTED YARN

BACKGROUND OF THE INVENTION

The invention relates to a method and a device with which it is possible to produce a finished twisted yarn in one working step from dissolved fiber material directly after producing spun yarns.

Such combined or integrated spinning/twisting methods are, for example, known from East German Patent 78 710 and Japanese Application 4 240 226. In these disclosed methods two open end spinning rotors positioned within a spindle rotor are used for producing the individual spun yarns which are subsequently guided to a centering point, positioned on an extension of the axis of the spindle rotor, while the spindle rotor is rotating. Subsequently, they are removed as a finished twisted yarn with a winding device in order to be wound to a finished bobbin.

The two prior art references contain only general information with respect to the supply of dissolved fiber material to the spinning rotors, for example, that the supply of fibers to the spinning rotors should be performed especially pneumatically, in general, with the vacuum which is present within the rotor chambers, as is disclosed for an individual spinning rotor in German application 26 15 505 without providing concrete solutions with respect to the required method and the construction of the device.

It is therefore an object of the present invention to provide for a method and device of the aforementioned kind measures for supplying the dissolved fiber material into the area of the spinning rotors.

SUMMARY OF THE INVENTION

The inventive method for manufacturing a twisted yarn in a yarn twisting machine, comprising a twisting spindle with a spindle rotor comprising a vacuum chamber in which at least two spinning rotors are positioned, is primarily characterized by the following steps:

Generating a vacuum within the vacuum chamber;

Dissolving fiber material to produce individual staple fibers;

Feeding the individual staple fibers by means of the vacuum into an annular channel located within the spindle rotor;

Intermediately storing the individual staple fibers in the annular channel;

Supplying the individual staple fibers by means of the vacuum from the annular channel through supply channels to the spinning rotor;

Spinning in the spinning rotors individual spun yarns from the individual staple fibers;

Gathering the individual spun yarns from the spinning rotors in a centering device above the spinning rotors to form a twisted yarn from the individual spun yarns; and Winding the twisted yarn onto a bobbin.

Preferably, the spinning rotors are open end spinning rotors into which the supply channels open.

Preferably, the method further comprises the steps of arranging the annular channel at the periphery of the spindle rotor, positioning a stationary cylindrical housing of the spindle so as to surround the spindle rotor, delimiting the annular channel radially outwardly with the housing of the spindle, and sealing the annular channel in the axial direction of the spindle.

Preferably, in the step of sealing labrynth seals are used.

Advantageously, the method further comprises the step of arranging the annular channel at the end face of an upper end of the spindle rotor.

The present invention further relates to a device for producing a twisted yarn which is primarily characterized by:

A spindle rotor comprising a hollow spindle axle connected to a vacuum source and further comprising a vacuum chamber connected to the hollow spindle axle;

A means for dissolving fiber material to produce individual staple fibers;

At least two spinning rotors positioned in the vacuum chamber for spinning spun yarn from the individual staple fibers;

A centering device positioned above the spinning rotors on the axis of the hollow spindle axle;

The spindle rotor further comprising an annular channel for receiving the individual staple fibers from the means of dissolving;

The spindle rotor further comprising supply channels, connected between the annular channel and the spinning rotors, for supplying the individual staple fibers from the annular channel to the spinning rotors;

The spindle rotor further comprising spun yarn removal channels for removing the spun yarns from the spinning rotors and guiding the spun yarns to the centering device; and A winding device for winding the twisted yarn, produced by the spindle rotor from the spun yarns and guided through the centering device, onto a bobbin.

Preferably, the spinning rotors are open end spinning rotors driven in rotation counter to a direction of rotation of the spindle rotor and the spun yarn removal channels extend into the spinning rotors along an axis of rotation of the spinning rotors.

Advantageously, the device further comprises a stationary cylindrical housing in which the spindle rotor is positioned. The housing delimits the annular channel in the radially outward direction and has at least one fiber inlet for feeding the individual staple fibers to the annular channel.

In a preferred embodiment of the present invention, the annular channel is positioned at the periphery of the spindle rotor and is sealed in the axial direction.

Preferably, the device further comprises a sealing element for sealing the annular channel, wherein the sealing element is a labrynth seal and is positioned between the inner wall of the housing and the outer mantle surface of the spindle rotor.

In yet another embodiment of the present invention, the sealing element in a circumferential direction of the annular channel has return threads of opposite pitch orientation relative to the annular channel.

In a preferred embodiment of the present invention, the spindle rotor further comprises a cover plate positioned atop the vacuum chamber, wherein the annular channel is arranged in the cover plate.

Advantageously, the spun fiber removal channels extend through the cover plate radially inwardly and upwardly from the spinning rotors toward the axis of rotation of the spindle rotor. The cover plate further comprises a centrally positioned removal member into which the spun fiber removal channels open. The annular channel preferably surrounds the removal member at a distance.

Expediently, the supply channels extend downwardly and radially outwardly from the annular channel into the spinning rotors.

Preferably, the spinning rotors are open end spinning rotors driven in rotation counter to a direction of rotation of the spindle rotor.

In yet another embodiment of the present invention the device further comprises electric motors for driving the spinning rotors.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
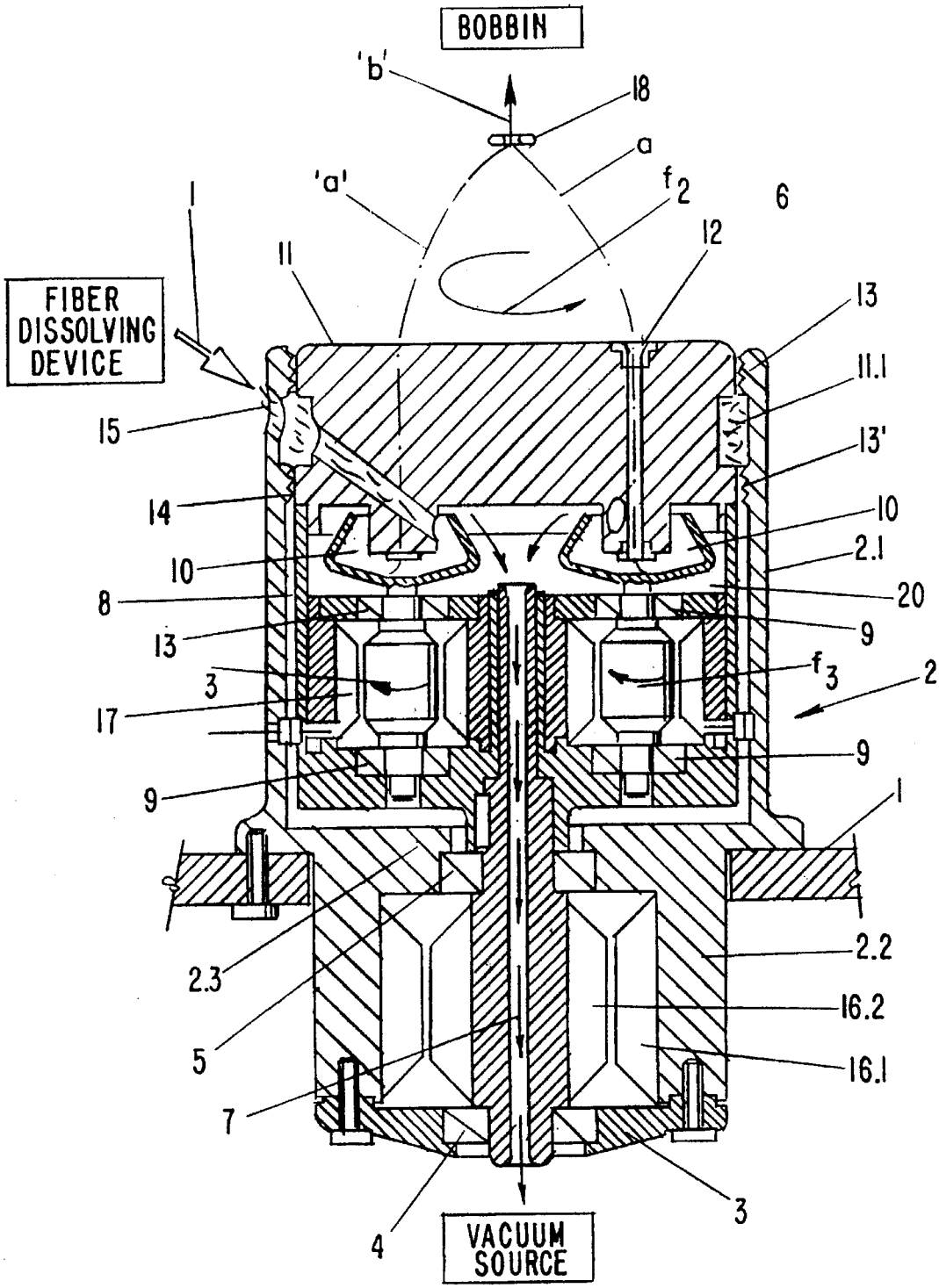
FIG. 1 shows an axial section of the invention device.

FIG. 1 shows a spindle frame 1 as a part of an otherwise non-represented spinning and twisting machine. A stationary cylindrical housing 2 is fastened to the spindle frame 1 and is comprised of an upper housing section 2.1 and a lower housing section 2.2 with an intermediate partition 2.3. The lower end of the lower housing section 2.2 is closed by a bottom 3. In openings of the partitions 2.3 of the bottom 3 bearings 4 and 5 for supporting the hollow spindle axle 7 of a spindle rotor 6 are arranged. The hollow spindle axle 7 supports a pot 8 in which are rotatably supported two open end spinning rotors 10 on bearings 9 so as to be positioned adjacent to one another with parallel axis. The upper end of the pot 8 is closed by a cover plate 11 which in the extension of the axis of the spinning rotors 10 is provided with spun fiber removal channels 12 only one of which is represented in FIG. 1 as well as in FIG. 2 indicating schematically that instead of two spinning rotors 10 it is also possible to provide a plurality of spinning rotors, for example, three spinning rotors which would then be arranged so as to be spaced at an angular distance of 120° relative to one another. The cover plate 11 delimits at the upper portion of the pot 8 a vacuum chamber 20 in which the spinning rotors 10 are received. The vacuum chamber 20 is connected via the hollow spindle axle 7 to a vacuum source.

The cover plate 11 of the spindle rotor 6 is provided at its periphery with an annular channel 11.1 which is delimited radially outwardly by the upper housing section 2.1. For sealing the annular channel 11.1 in the area between the outer mantle surface of the cover plate 11 and the inner wall of the upper housing section 2.1 so-called gap seals or labrynth seals 13, 13' are provided which in the circumferential direction of the gap, respectively, of the annular channel are provided between the spindle rotor 6 and the upper housing section 2.1 with return threads that in respect to the annular channel are provided with opposite pitch.

The upper housing section 2.1 is provided with at least one fiber supply inlet 15 opening into the annular channel 11.1. Upstream of the fiber inlet 15 a fiber material dissolving device is provided for supplying dissolved fiber material in direction of arrow f1 into the annular channel 11.1. Such a fiber dissolving device is, in general, in the form of so-called opening rollers with which loosely gathered fiber strands are dissolved or individualized to form individual staple fibers. Supply channels 14 extend from the annular channel 11.1 into each one of the spinning rotors 10.

The spindle rotor 6 is driven by, for example, an electric motor in the direction of arrow f2, as schematically shown by the electric motor stator part 16.1, respectively, the electric motor rotor part 16.2.

The spinning rotors 10 are preferably also driven by electric motors, for example, the electric motor stator part 17 cooperating with a rotor part connected within the spinning rotors. Preferably, the spinning rotors 10 are driven in the opposite direction f2 as the spindle rotor 6. The energy supply can be carried out in a conventional manner, for example, with slide rings.

When, due to the vacuum present within the vacuum chamber 20, individual staple fibers are supplied via the supply channels 14 to the spinning rotors 10 while the spindle rotor 6 and the spinning rotors 10 rotate in opposite directions, spun yarns "a" are generated in the spinning rotors 10. These spun yarns are removed via the spun yarn removal channels 12 in the upward direction and in the area of the centering device in the form of a centering eyelet 18 are gathered to form a twisted yarn "b". The twisted yarn "b" is then wound, for example, by a conventional yarn removal (winding) machine onto a bobbin, as is conventional in two-for-one twisting machines.

Figure 2:
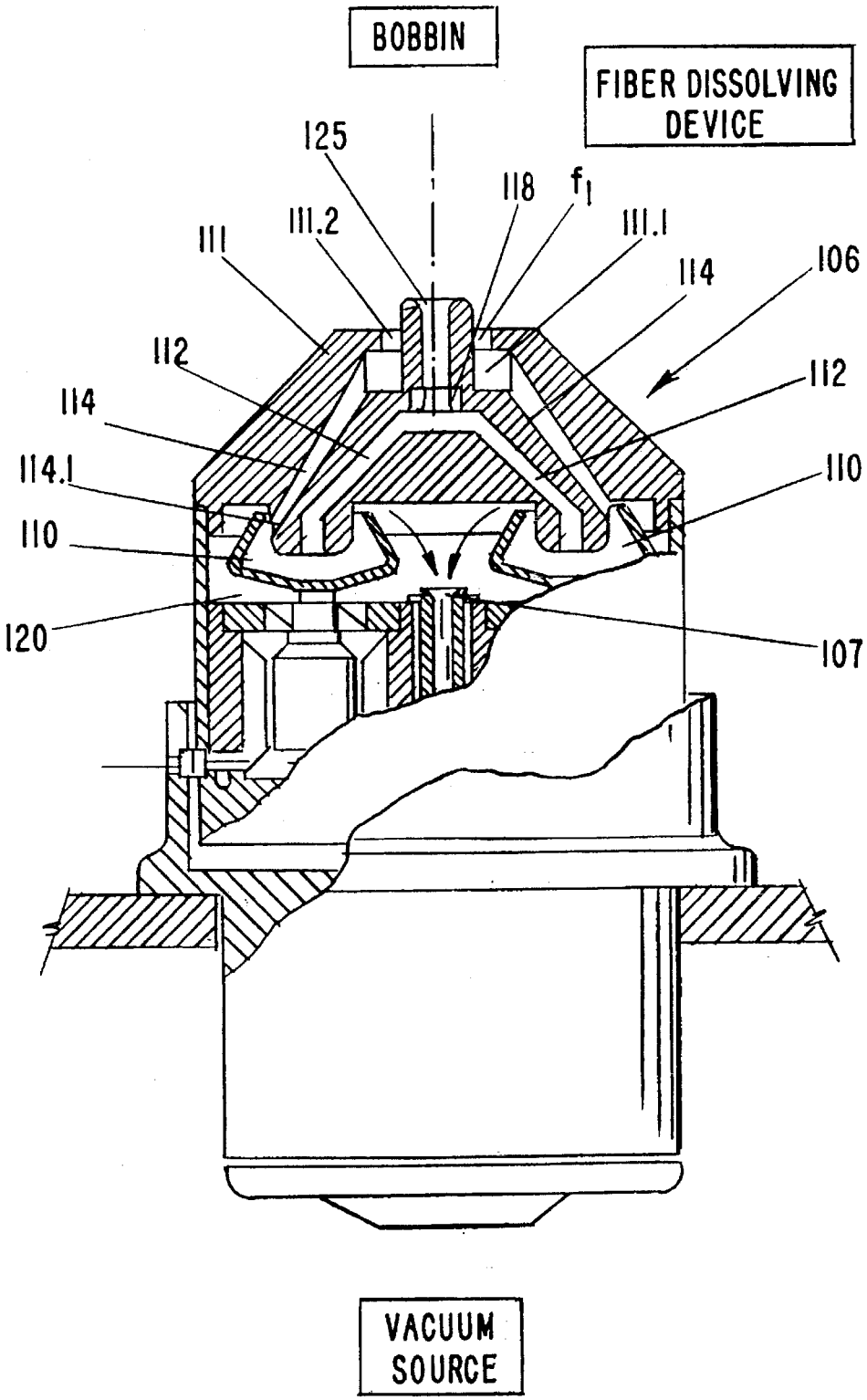
FIG. 2 shows in a similar representation a second embodiment of the invention.

The embodiment represented in FIG. 2 shows an annular channel 111.1 in the area of the upper side of the cover plate 111 of the spindle rotor 106. Individual staple fibers that are supplied via the annular gap 111.2 are forced by the centrifugal force against the outer wall of the annular channel 111.1 so that they are aligned and oriented before they are sucked by the vacuum present within the vacuum chamber 120, connected via the hollow spindle axle 107 to a vacuum source, through the annular channel 111.1 and the supply channels 114 into the spinning rotors 110.

The spun yarn removal channels 112 extending upwardly and radially inwardly from the spinning rotors 110 toward the axis of rotation of the hollow spindle axle 107 are guided through the cover plate 111 and open into a common removal member 125 centrally arranged within the cover plate 11. The annular channel 111.1 surrounds the removal member 125 at a short distance, as can be seen in FIG. 2. This removal member 125 has coordinated therewith a centering device, preferably in the form of a centering eyelet 118. The supply channels 114 extend from the annular channel 111.1 at a slant downwardly and radially outwardly and open with their outlet openings 114.1 into the spinning rotors 110. The other constructive elements of the spindle represented in FIG. 2 correspond to the elements represented in FIG. 1 and are therefore not described in detail.

In the embodiments represented in FIGS. 1 and 2 the annular channels 11.1, respectively, 111.1 have a buffering, respectively, intermediate storage function for the individual staple fibers supplied thereto.

The present invention is, of course, in no way restricted to the specific disclosure of the specification and drawings, but also encompasses any modifications within the scope of the appended claims.

What we claim is:

1. A method for manufacturing a twisted yarn in a yarn twisting machine comprising a twisting spindle with a rotating spindle rotor comprising a vacuum chamber, said method comprising the steps of:

positioning at least two spinning rotors in the vacuum chamber;

generating a vacuum within the vacuum chamber;

dissolving fiber material to produce individual staple fibers;

feeding the individual staple fibers by means of said vacuum into an annular channel located within the spindle rotor;

intermediately storing the individual staple fibers in said annular channel;

supplying the individual staple fibers by means of said vacuum from the annular channel through supply channels to the spinning rotors;

spinning in the spinning rotors individual spun yarns from the individual staple fibers;

gathering the individual spun yarns from the spinning rotors in a centering device above the spinning rotors to form a twisted yarn from the individual spun yarns; and winding the twisted yarn onto a bobbin.

2. A method according to claim 1, wherein said spinning rotors are open end spinning rotors into which said supply channels open.

3. A method according to claim 1, wherein said step of positioning further comprises the steps of:

arranging said annular channel at the periphery of said spindle rotor;

positioning a stationary cylindrical housing of said spindle so as to surround said spindle rotor;

delimiting said annular channel radially outwardly with said housing of said spindle; and sealing said annular channel in the axial direction of said spindle.

4. A method according to claim 3, wherein in said step of sealing a labyrinth seal is used.

5. A method according to claim 1, wherein the spindle rotor has an upper end with an end face, further comprising the step of arranging said annular channel at the end face of the upper end of said spindle rotor.

6. A device for producing a twisted yarn, said device comprising:

a rotating spindle rotor comprising a hollow spindle axle connected to a vacuum source and further comprising a vacuum chamber connected to said hollow spindle axle;

a means for dissolving fiber material to produce individual staple fibers;

at least two spinning rotors positioned in said vacuum chamber for spinning spun yarns from the individual staple fibers;

a centering device positioned above said spinning rotors on the axis of said hollow spindle axle;

said spindle rotor further comprising an annular channel for receiving the individual staple fibers from said means of dissolving;

said spindle rotor further comprising supply channels, connected between said annular channel and said spinning rotors, for supplying the individual staple fibers from said annular channel to said spinning rotors;

said spindle rotor further comprising spun yarn removal channels for removing the spun yarns from said spinning rotors and guiding the spun yarns to said centering device; and a winding device for winding the twisted yarn, produced by said spindle rotor from said spun yarns and guided through said centering device, onto a bobbin.

7. A device according to claim 6, wherein said spinning rotors are open end spinning rotors driven in rotation counter to a direction of rotation of said spindle rotor and wherein said spun yarn removal channels extend into said spinning rotors along an axis of rotation of said spinning rotors.

8. A device according to claim 6, further comprising a stationary cylindrical housing in which said spindle rotor is positioned, said housing delimiting said annular channel in a radially outward direction relative to an axis of rotation of said spindle rotor, said housing having at least one fiber inlet for feeding the individual staple fibers to said annular channel.

9. A device according to claim 8, wherein said annular channel is positioned at the periphery of said spindle rotor and is sealed in the axial direction of said axis of rotation of said spindle rotor.

10. A device according to claim 9, further comprising a sealing element for sealing said annular channel, wherein said sealing element is a labyrinth seal and is positioned between an inner wall of said housing and an outer mantle surface of said spindle rotor.

11. A device according to claim 10, wherein said sealing element in a circumferential direction of said annular channel has return threads of opposite pitch orientation relative to said annular channel.

12. A device according to claim 6, wherein said spindle rotor further comprises a cover plate positioned atop said vacuum chamber, wherein said annular channel is arranged in said cover plate.

13. A device according to claim 12, wherein:

said spun fiber removal channels extend through said cover plate radially inwardly and upwardly from said spinning rotors toward the axis of rotation of said spindle rotor;

said cover plate further comprises a centrally positioned removal member into which said spun fiber removal channels open; and said annular channel surrounds said removal member at a distance.

14. A device according to claim 12, wherein said supply channels extend downwardly and radially outwardly from said annular channel into said spinning rotors.

15. A device according to claim 14, wherein said spinning rotors are open end spinning rotors driven in rotation counter to a direction of rotation of said spindle rotor.

16. A device according to claim 6, further comprising electric motors for driving said spinning rotors.

* * * * *